US007652633B2

(12) United States Patent
Mai et al.

(10) Patent No.: US 7,652,633 B2
(45) Date of Patent: Jan. 26, 2010

(54) ANTENNA FOR GPS

(75) Inventors: Ching-Chia Mai, Kaohsiung (TW); Cheng-Han Lee, Kaohsiung (TW); Chi-Yueh Wang, Kaohsiung (TW); Boon-Tiong Chua, Kaohsiung (TW)

(73) Assignee: Yageo Corporation, Kaohsiung (TW)

( * ) Notice: Subject to any disclaimer, the term of this patent is extended or adjusted under 35 U.S.C. 154(b) by 117 days.

(21) Appl. No.: 11/849,393

(22) Filed: Sep. 4, 2007

(65) Prior Publication Data

US 2008/0158088 A1 Jul. 3, 2008

(30) Foreign Application Priority Data

Dec. 28, 2006 (TW) ..... 95149568 A

(51) Int. Cl.
*H01Q 1/38* (2006.01)

(52) U.S. Cl. ..... 343/833; 343/702; 343/846

(58) Field of Classification Search ..... 343/700 MS, 343/833, 846, 702, 834
See application file for complete search history.

(56) References Cited

U.S. PATENT DOCUMENTS 4,907,006 A * 3/1990 Nishikawa et al. .... 343/700 MS

* cited by examiner

*Primary Examiner*—Michael C Wimer
(74) *Attorney, Agent, or Firm*—Volentine & Whitt, PLLC

(57) ABSTRACT

This invention relates to an antenna for GPS. The antenna of the invention comprises a ground metal plate, a parasitic metal plate, a radiation metal plate and at least one supporting element. The parasitic metal plate is disposed above the ground metal plate and connects to the ground metal plate. The radiation metal plate is an independent metal plate and is disposed above the ground metal plate. The parasitic metal plate cooperates with the radiation metal plate to induce a resonance mode. The supporting element is disposed on the ground metal plate and is used to support the radiation metal plate. Whereby, the problems of large size and limited receiving angle of signal according to a conventional circular polarization antenna for GPS could be improved.

22 Claims, 9 Drawing Sheets

ANTENNA FOR GPS

BACKGROUND OF THE INVENTION

1. Field of the Invention

The present invention relates to an antenna for wireless network, and more particularly to an antenna for GPS.

2. Description of the Related Art

Along with the rapid development of wireless communication technology, various communication products emerge in quick succession. Thus, wireless communication products gradually become a part of people's life, and nearly all the new products have the function of wireless transmission to cater for the mass. As notebooks or mobile multimedia devices often need data transmission, and wireless transmission can simplify the wirings and settings, an antenna is required to achieve wireless transmission. In order to be widely accepted in the market, it is critical for notebooks or mobile multimedia devices with wireless transmission function to have preferred appearance, size, and performances, so it is more important to have a good antenna design and dispose the antenna at an appropriate position.

Conventional antennae for Global Positioning System (GPS) are ceramic circular polarization antennae for GPS, which have disadvantages that it cannot be customized and has a limited receiving angle. As current electronic devices are increasingly miniaturized, the inner space for accommodating other peripheral elements is limited. Thus, due to space limitation, the conventional circular polarization antennae for GPS are rather difficult to be applied to products (for example, notebook) with a small volume, so the application range is limited.

Moreover, as the electromagnetic field pattern of the conventional circular polarization antenna for GPS is right circularly polarized, the angle of receiving signals emitted by satellites is only limited to a range of about 15° above the conventional circular polarization antenna for GPS. Therefore, the conventional circular polarization antenna for GPS cannot receive signals from sides, which results in many dead angles.

Therefore, it is necessary to provide an antenna for GPS, so as to solve the above problems.

SUMMARY OF THE INVENTION

The present invention is to provide an antenna for GPS. The antenna comprises a ground metal plate, a parasitic metal plate, a radiation metal plate, and at least one supporting element. The parasitic metal plate is disposed above the ground metal plate and connects to the ground metal plate. The radiation metal plate is an independent metal plate and is disposed above the ground metal plate. The parasitic metal plate cooperates with the radiation metal plate to induce a resonance mode. The supporting element is disposed on the ground metal plate and is used to support the radiation metal plate.

The antenna for GPS provided by the present invention is a linear polarization antenna for GPS, which has the advantages that the antenna can be easily customized, applied to various wireless communication products, enhance the ability of receiving signal from sides, and broaden the receiving angle, thus solving the problem that the conventional circular polarization antenna for GPS cannot receive signals from sides and has many dead angles.

DETAILED DESCRIPTION OF THE INVENTION

Figure 1A:
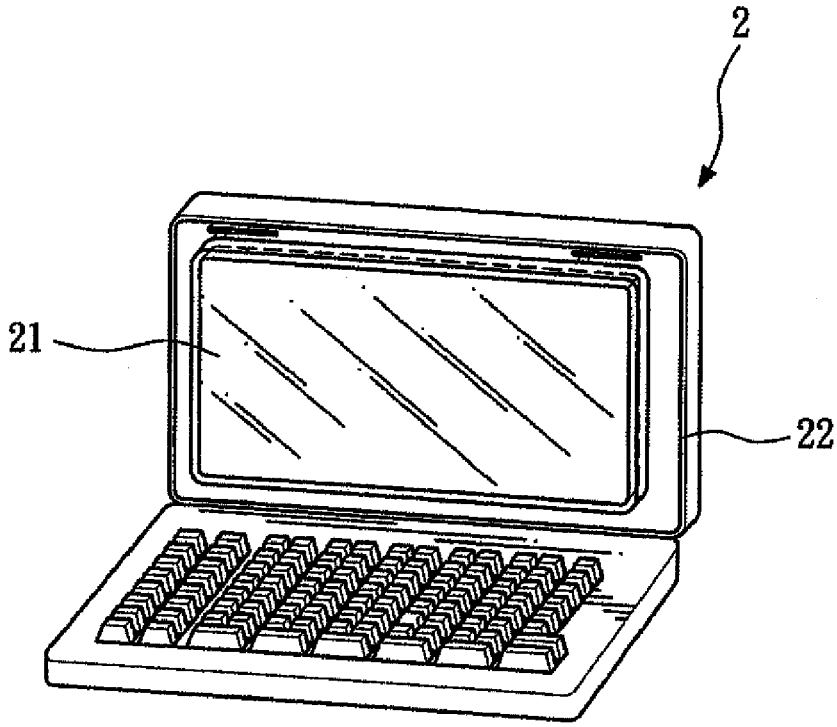
FIG. 1A is a schematic view of an antenna of the present invention disposed in a screen case frame of an electronic device.
Figure 1B:
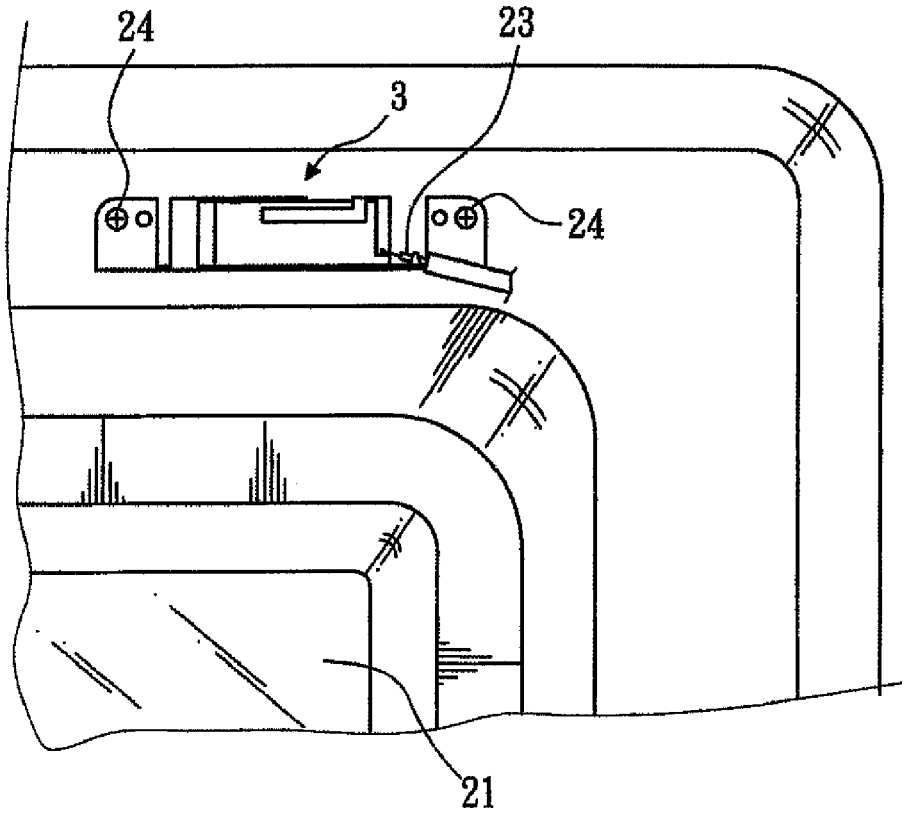
FIG. 1B is a partial enlarged schematic view of an antenna of the present invention disposed in a screen case frame of an electronic device.

Referring to FIGS. 1A and 1B, the configuration structure of an integrated antenna applied to an electronic device 2 (a notebook in this embodiment) according to the present invention is shown. The present invention is applicable to various wireless electronic devices including, but not limited to, notebooks. Common electronic devices such as personal digital assistants (PDAs) can utilize the integrated antenna of the present invention to realize wireless communication. The electronic device 2 has a screen 21 and a screen case frame 22. The antenna 3 for GPS according to the present invention is disposed in the screen case frame 22 of the electronic device 2, and is connected to a control circuit of the electronic device 2 via a coaxial conductor 23 for data transmission.

The antenna 3 for GPS has at least one fixing portion for fixing the antenna 3 for GPS to the screen case frame 22. In this embodiment, the fixing portions are two through holes 35 (as shown in FIG. 2), through which two screws 24 fix the antenna 3 for GPS to the screen case frame 22 of the electronic device 2 (as shown in FIG. 1B).

Figure 2:
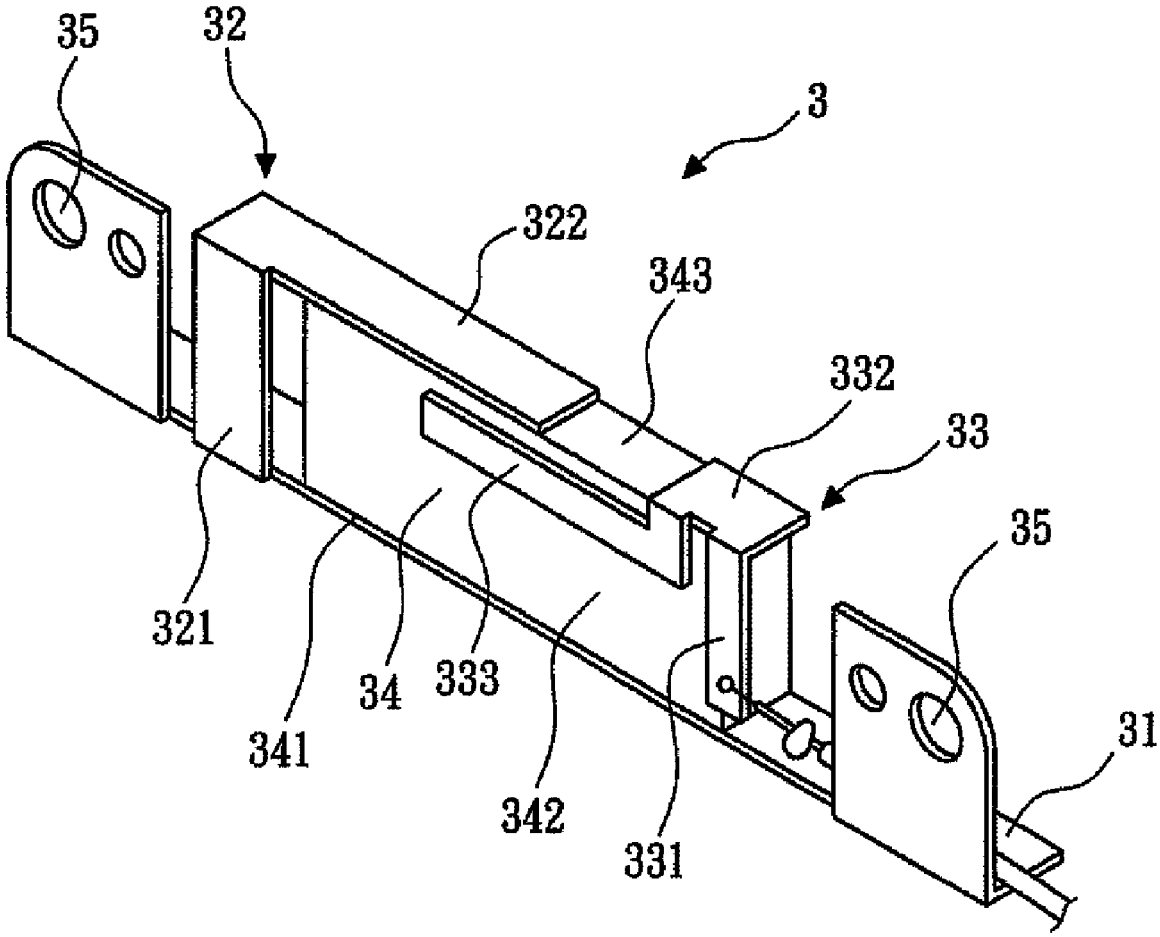
FIG. 2 is a schematic view of an antenna for GPS according to a first embodiment of the present invention.

Referring to FIG. 2, a schematic view of the antenna 3 for GPS according to a first embodiment of the present invention is shown. In the first embodiment, the antenna for GPS comprises a ground metal plate 31, a parasitic metal plate 32, a radiation metal plate 33, and at least one supporting element 34.

The ground metal plate 31 is disposed on a first side surface. The parasitic metal plate 32 is disposed above the ground metal plate 31 and connects to the ground metal plate 31. In the first embodiment, the parasitic metal plate 32 has a first portion 321 and a second portion 322. The first portion 321 is disposed on a second side surface, which is adjacent to the first side surface, and the second portion 322 is disposed on a third side surface, which is opposite to the first side surface. The first portion 321 of the parasitic metal plate 32 is connected to the ground metal plate 31.

The radiation metal plate 33 is an independent metal plate and is disposed above the ground metal plate 31. The parasitic metal plate 32 cooperates with the radiation metal plate 33 to induce a resonance mode, in which a frequency of the resonance mode is 1575 MHz. Though the cooperation of the parasitic metal plate 32 and the radiation metal plate 33, a zero electric potential is generated between the parasitic metal plate 32 and the radiation metal plate 33. Moreover, the wavelength excited by the parasitic metal plate 32 and the radiation metal plate 33 is a half wavelength, such that in an application of a frequency of 1575 MHz (the frequency of GPS), the parasitic metal plate 32 and the radiation metal plate 33 can have short length.

The radiation metal plate 33 has a first portion 331, a second portion 332, and a third portion 333. The first portion 331 is disposed on the second side surface, the second portion 332 is disposed on the third side surface, the third portion 333 is disposed on the second side surface. The second portion 322 of the parasitic metal plate 32 is located at a corresponding position above a first end of the ground metal plate 31, and extends towards the radiation metal plate 33. The third portion 333 of the radiation metal plate 33 is located at a corresponding position above a second end of the ground metal plate 31, and extends towards the parasitic metal plate 32. The second end is opposite to the first end. The supporting element 34 is disposed on the ground metal plate 31, and is used to support the radiation metal plate 33. Preferably, the supporting element 34 is an insulating element.

In the first embodiment, the supporting element 34 is a ceramic substrate having a first side surface 341, a second side surface 342, and a third side surface 343. The second side surface 342 is adjacent to the first side surface 341, and the third side surface 343 is opposite to the first side surface 341. The ground metal plate 31 is disposed on the first side surface 341 of the ceramic substrate. The first portion 321 of the parasitic metal plate 32 extends along a side of the ground metal plate 31, and is disposed on the second side surface 342 of the ceramic substrate. The second portion 322 of the parasitic metal plate 32 is disposed on the third side surface 343 of the ceramic substrate. The first portion 331 of the radiation metal plate 33 is disposed on the second side surface 342 of the ceramic substrate, the second portion 332 is disposed on the third side surface 343 of the ceramic substrate, and the third portion 333 is disposed on the second side surface 342 of the ceramic substrate. In other applications, the supporting element 34 can also be a non-conductive solid material.

Figure 3A:
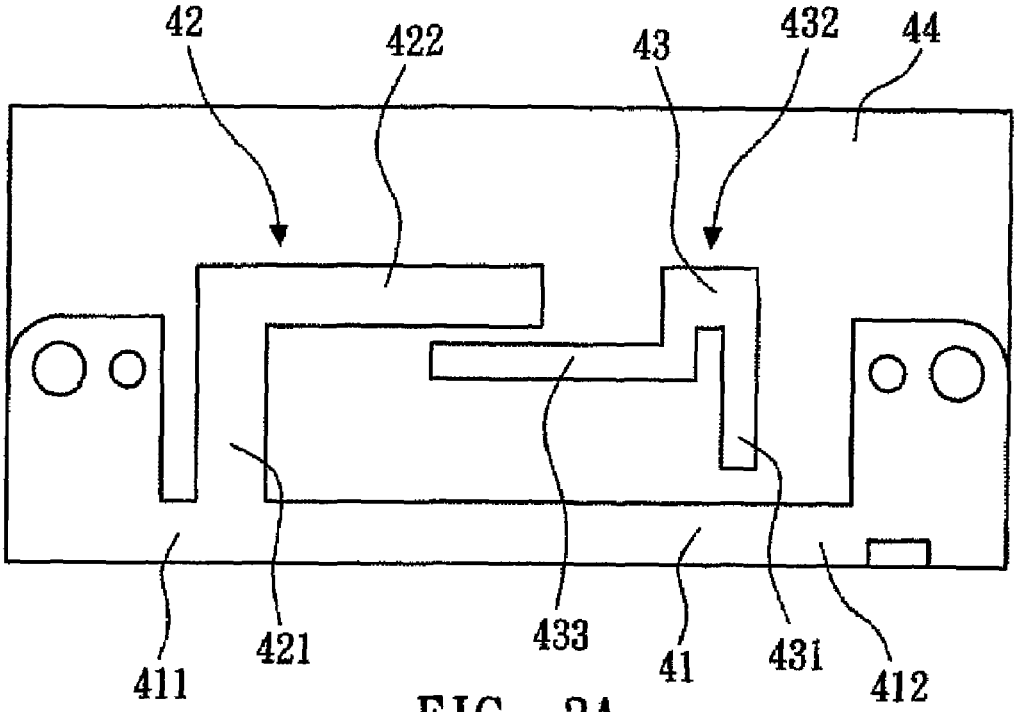
FIG. 3A is a schematic view of an antenna for GPS according to a second embodiment of the present invention (before the flexible PCB is bent)
Figure 3B:
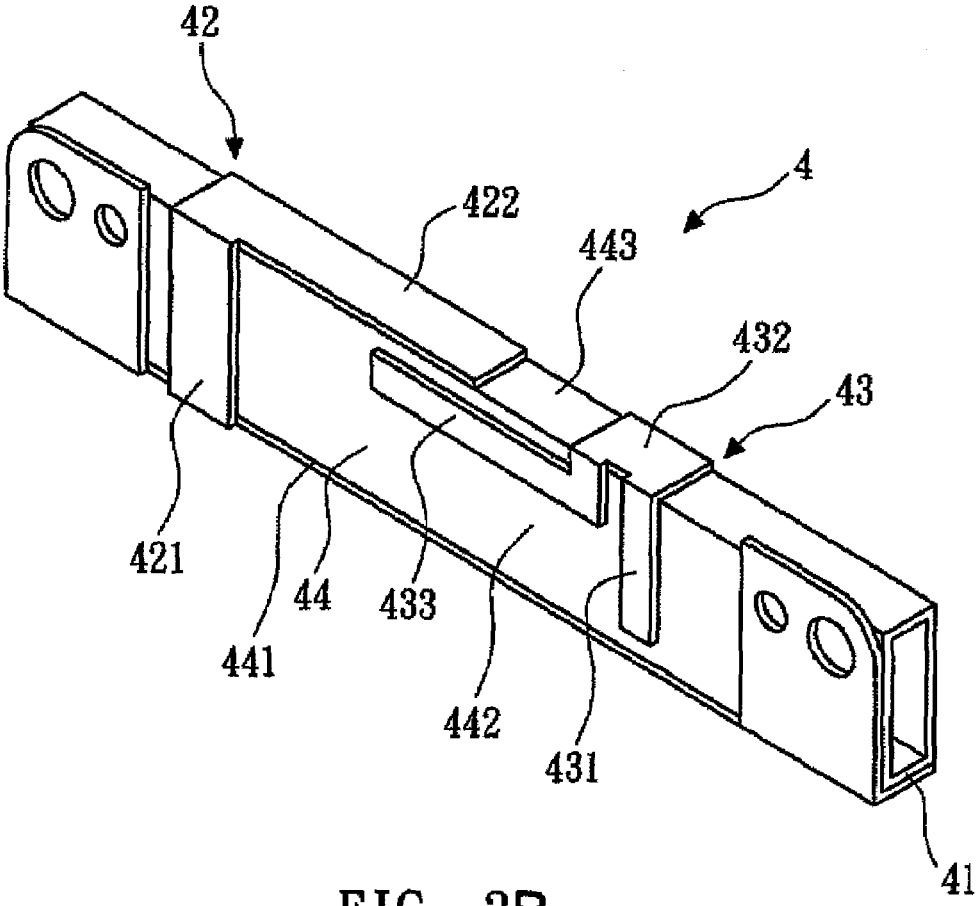
FIG. 3B is a schematic view of a flexible PCB folded into a cuboid according to the present invention (after the flexible PCB is bent)

Referring to FIGS. 3A and 3B together, a schematic view of an antenna 4 for GPS according to a second embodiment of the present invention is shown. In the second embodiment, the antenna 4 for GPS comprises a ground metal plate 41, a parasitic metal plate 42, a radiation metal plate 43, and at least one supporting element 44. In the second embodiment, the supporting element 44 is a flexible printed circuit board (PCB). The ground metal plate 41 has a first end 411 and a second end 412, and is disposed at a bottom edge of the flexible PCB.

The parasitic metal plate 42 has a first portion 421 and a second portion 422. The first portion 421 of the parasitic metal plate 42 extends upward from a side of the ground metal plate 41 close to the first end 411. The second portion 422 of the parasitic metal plate 42 extends horizontally from the first portion 421 towards the second end 412 of the ground metal plate 41.

The radiation metal plate 43 has a first portion 431, a second portion 43, and a third portion 433. The first portion 431 of the radiation metal plate 43 is spaced by a distance from the side of the ground metal plate 41 close to the second end 412 and extends upward. The top of the first portion 431 of the radiation metal plate 43 and the top of the first portion 421 of the parasitic metal plate 42 are spaced by the same distance from the ground metal plate 41. The second portion 432 of the radiation metal plate 43 is disposed at the same level as the second portion 422 of the parasitic metal plate 42. The second portion 432 of the radiation metal plate 43 extends toward the first end 411 of the ground metal plate 41. The third portion 433 of the radiation metal plate 43 extends from the bottom of the second portion 432 towards the first end 411 of the ground metal plate 41 until between the ground metal plate 41 and the second portion 422 of the parasitic metal plate 42.

Next, the flexible PCB 44 is folded into a cuboid 44, so as to form the antenna 4 for GPS according to the second embodiment. Referring to FIG. 3B, the cuboid 44 has a first side surface 441, a second side surface 442, and a third side surface 443. The second side surface 442 is adjacent to the first side surface 441, and the third side surface 443 is opposite to the first side surface 441. The ground metal plate 41 is disposed on the first side surface 441 of the cuboid 44. The first portion 421 of the parasitic metal plate 42 extends along a side of the ground metal plate 41, and is disposed on the second side surface 442 of the cuboid 44. The second portion 422 of the parasitic metal plate 42 is disposed on the third side surface 443 of the cuboid 44. The first portion 431 of the radiation metal plate 43 is disposed on the second side surface 442 of the cuboid 44, the second portion 432 is disposed on the third side surface 443 of the cuboid 44, and the third portion 433 is disposed on the second side surface 442 of the cuboid 44.

Figure 4:
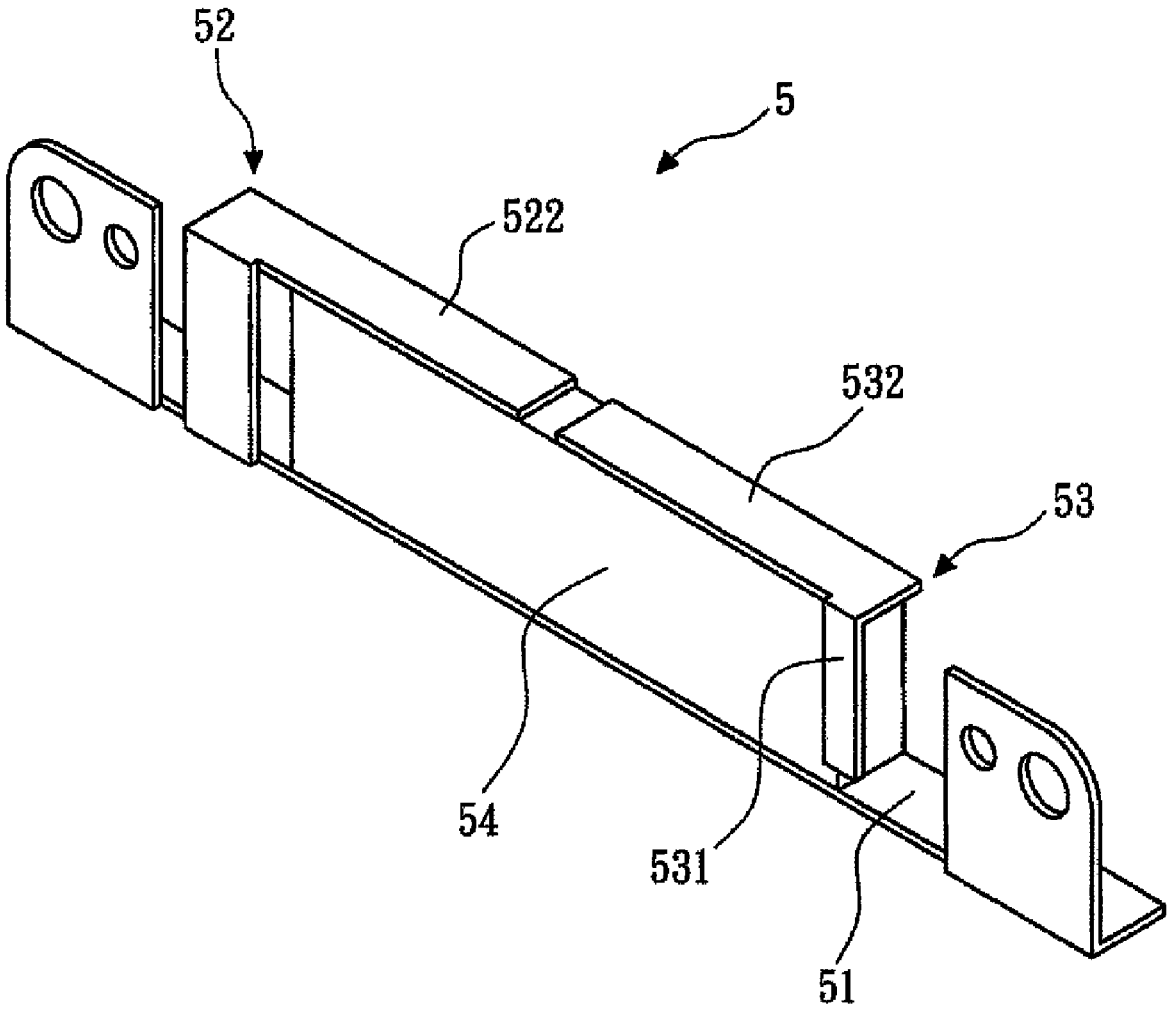
FIG. 4 is a schematic view of an antenna for GPS according to a third embodiment of the present invention.

Referring to FIG. 4, a schematic view of an antenna 5 for GPS according to a third embodiment of the present invention is shown. In the third embodiment, the antenna 5 for GPS comprises a ground metal plate 51, a parasitic metal plate 52, a radiation metal plate 53, and at least one supporting element 54. The difference between the antenna 5 for GPS of the third embodiment and the antenna 3 for GPS of the first embodiment in FIG. 2 is that the radiation metal plate 53 of the third embodiment has a first portion 531 and a second portion 532. The second portion 532 of the radiation metal plate 53 and the second portion 522 of the parasitic metal plate 52 are both disposed on a third side surface (i.e., a top surface relatively to the above of the ground metal plate 51).

It should be noted that, the supporting element 54 of the third embodiment can be a ceramic substrate or a non-conductive solid material. Or, the supporting element 54 of the third embodiment is a flexible PCB, and the ground metal plate 51, the parasitic metal plate 52, and the radiation metal plate 53 are respectively disposed on the flexible PCB. Then, the flexible PCB is folded into a cuboid antenna.

Figure 5:
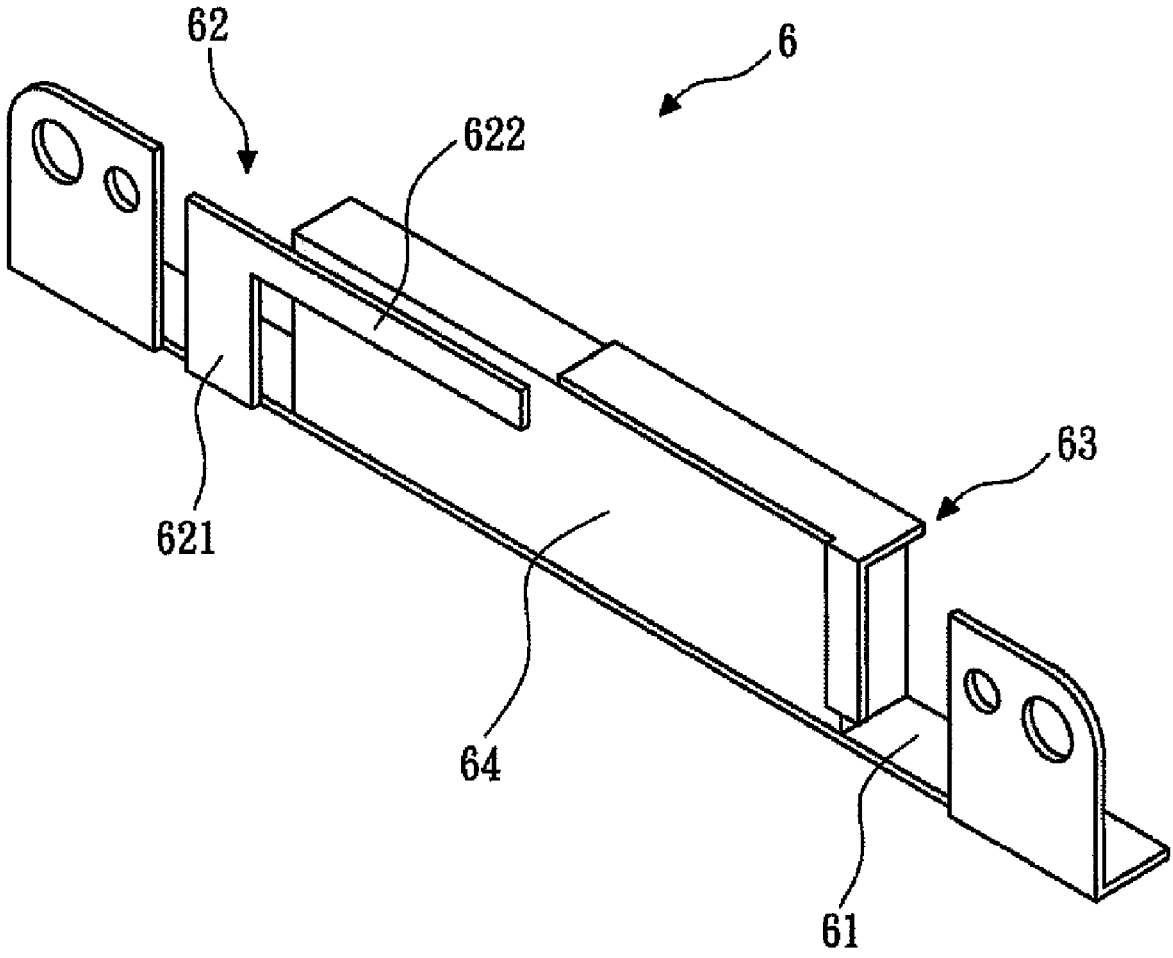
FIG. 5 is a schematic view of an antenna for GPS according to a fourth embodiment of the present invention.

Referring to FIG. 5, a schematic view of an antenna 6 for GPS according to a fourth embodiment of the present invention is shown. In the fourth embodiment, the antenna 6 for GPS comprises a ground metal plate 61, a parasitic metal plate 62, a radiation metal plate 63, and at least one supporting element 64. The difference between the antenna 6 for GPS of the fourth embodiment and the antenna 5 for GPS of the third embodiment in FIG. 4 is that the first portion 621 and the second portion 622 of the parasitic metal plate 62 in the fourth embodiment are both disposed on the second side surface (i.e., a front side surface adjacent to the ground metal plate 61).

Figure 6:
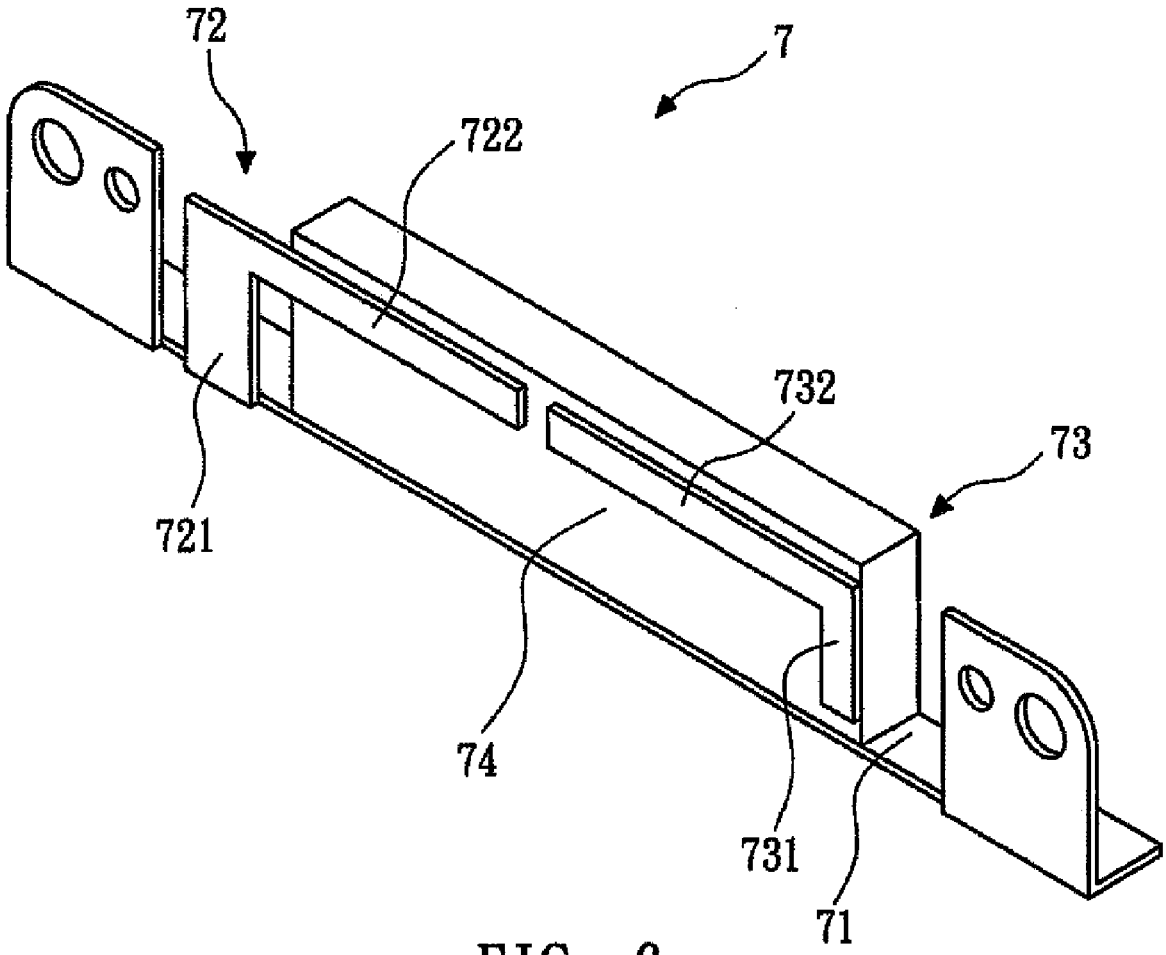
FIG. 6 is a schematic view of a first aspect of an antenna for GPS according to a fifth embodiment of the present invention.

Referring to FIG. 6, a schematic view of an antenna 7 for GPS according to a fifth embodiment of the present invention is shown. In the fifth embodiment, the antenna 7 for GPS comprises a ground metal plate 71, a parasitic metal plate 72, a radiation metal plate 73, and at least one supporting element 74. The difference between the antenna 7 for GPS of the fifth embodiment and the antenna 6 for GPS of the fourth embodiment in FIG. 5 is that in the fifth embodiment, the first portion 721 and the second portion 722 of the parasitic metal plate 72, the first portion 731 and the second portion 732 of the radiation metal plate 73 are all disposed on the second side surface (a front side surface adjacent to the ground metal plate 71 herein). Moreover, relative to the ground metal plate 71, the second portion 722 of the parasitic metal plate 72 is approximately at the same level as the second portion 732 of the radiation metal plate 73.

Figure 7:
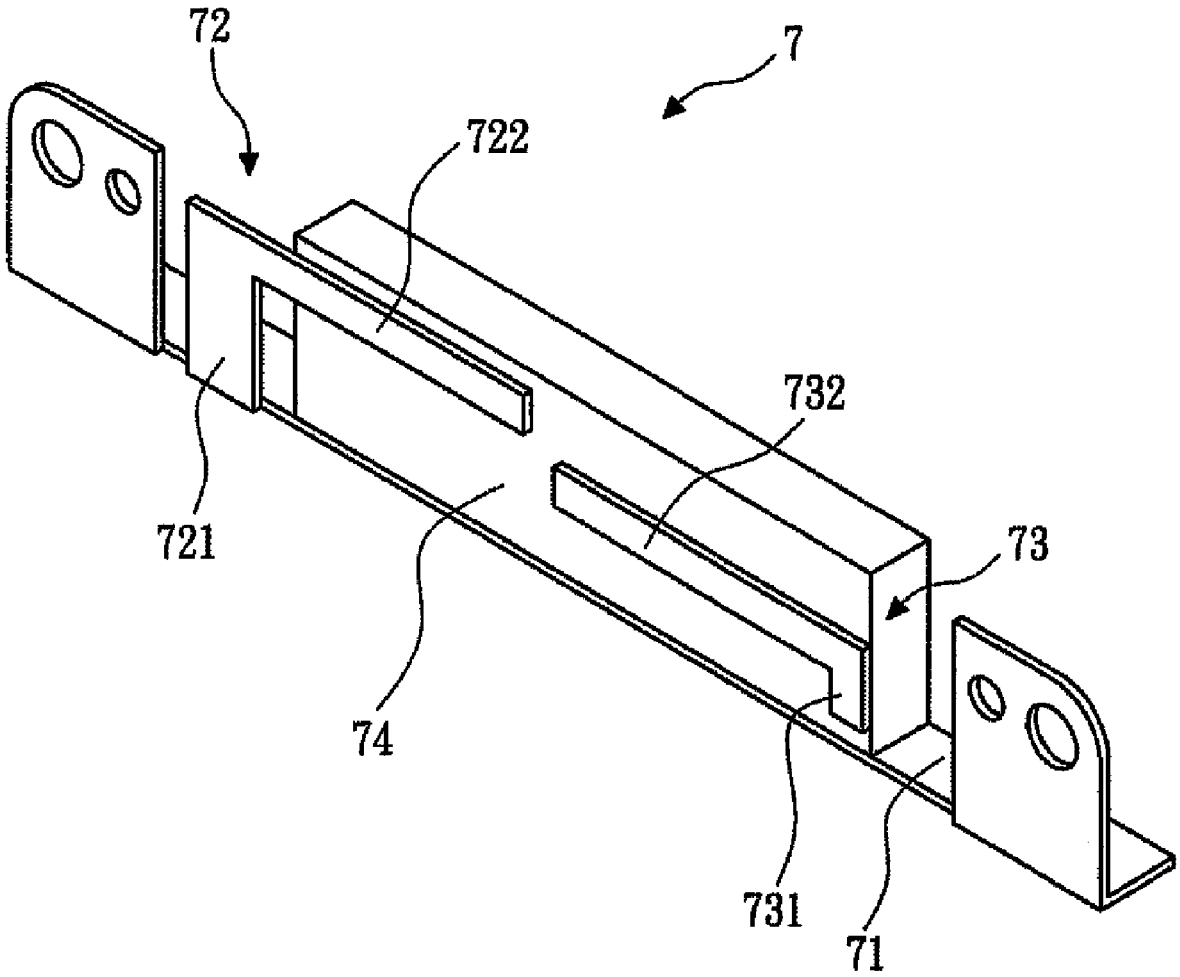
FIG. 7 is a schematic view of a second aspect of an antenna for GPS according to the fifth embodiment of the present invention.
Figure 8:
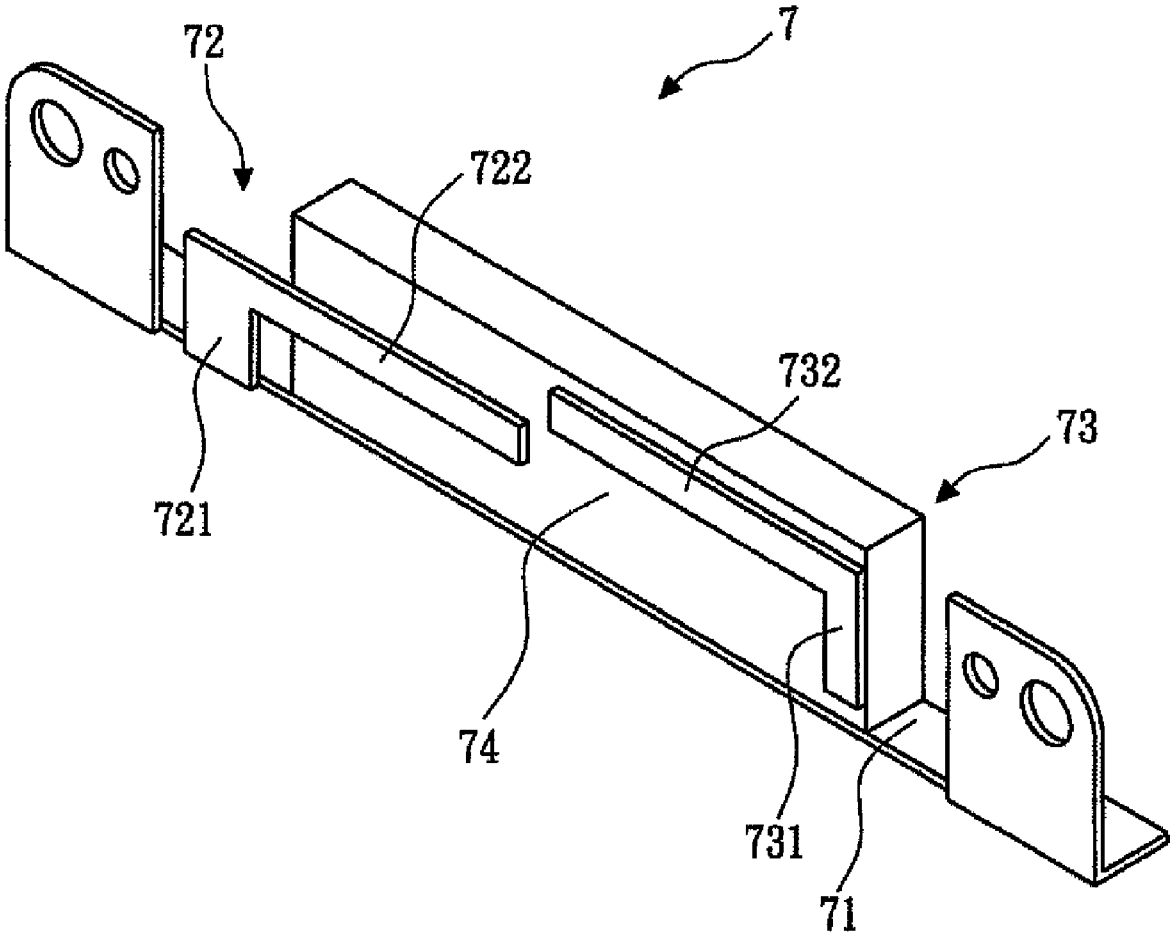
FIG. 8 is a schematic view of a third aspect of an antenna for GPS according to the fifth embodiment of the present invention.

Moreover, the antenna 7 for GPS according to the fifth embodiment also has the following different structural aspects of element configuration. Relative to the ground metal plate 71, the second portion 722 of the parasitic metal plate 72 is at a level higher than that of the second portion 732 of the radiation metal plate 73, as shown in FIG. 7. Or, relative to the ground metal plate 71, the second portion 722 of the parasitic metal plate 72 is at a level lower than that of the second portion 732 of the radiation metal plate 73, as shown in FIG. 8. The supporting element 74 of the antenna of various implementation aspects in the fifth embodiment can be a ceramic substrate or a non-conductive solid material.

Figure 9:
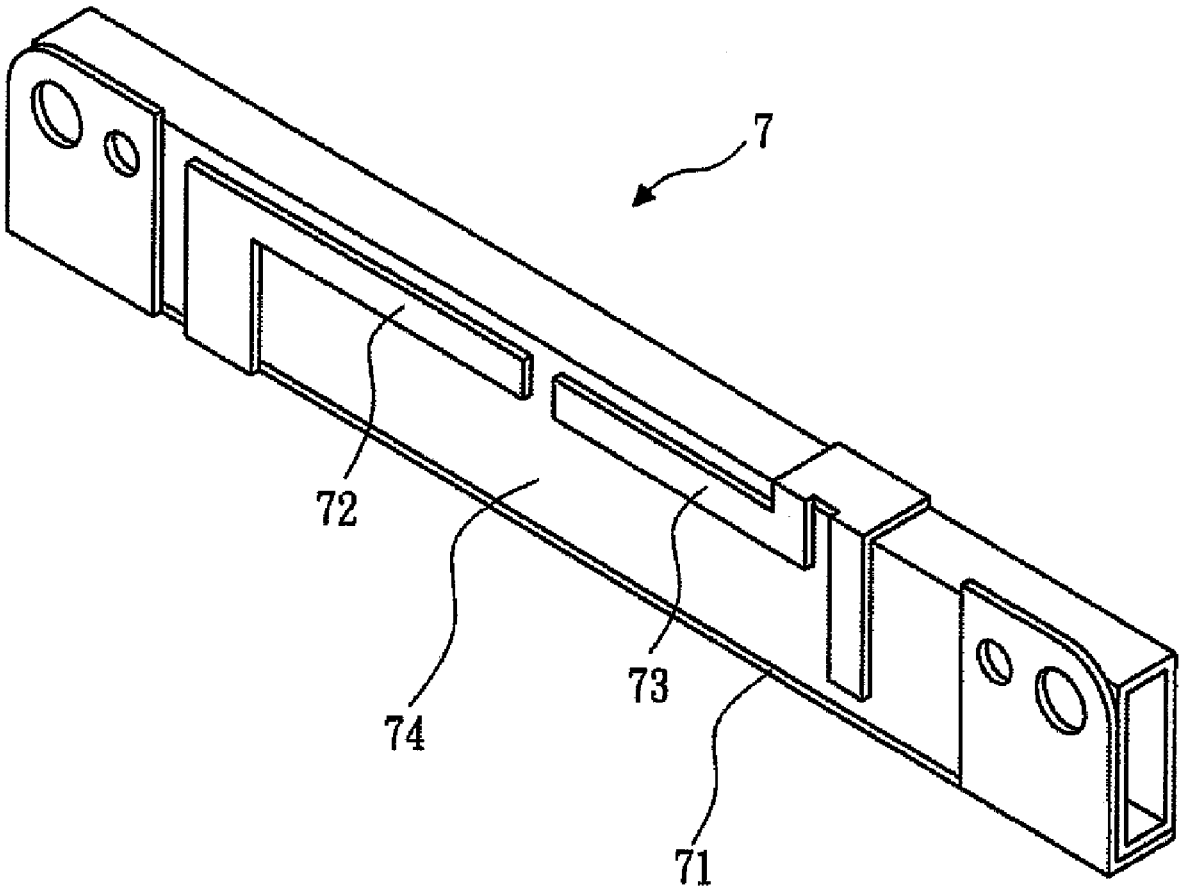
FIG. 9 is a schematic view of a fourth aspect of an antenna for GPS according to the fifth embodiment of the present invention (after the flexible PCB is bent).

It should be noted that, the supporting element 74 of the fifth embodiment can also be a flexible PCB. The ground metal plate 71, the parasitic metal plate 72, and the radiation metal plate 73 are respectively disposed on the flexible PCB. Then, the flexible PCB is folded into a cuboid antenna, as shown in FIG. 9.

The antenna for GPS provided by the present invention is a linear polarization antenna for GPS, which has following advantages that the antenna can be easily customized, adapted for various wireless communication products, enhance the ability of receiving signal from sides, and broaden the receiving angle, thus solving the problem that the conventional circular polarization antenna for GPS cannot receive signals from sides and has many dead angles.

While several embodiments of the present invention have been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. An antenna for GPS, comprising:

a ground metal plate;

a parasitic metal plate, disposed above the ground metal plate and connecting to the ground metal plate;

a radiation metal plate, disposed above the ground metal plate, wherein the radiation metal plate is an independent metal plate, and cooperates with the parasitic metal plate to induce a resonance mode; and at least one supporting element, disposed above the ground metal plate, for supporting the radiation metal plate, wherein the ground metal plate is disposed on a first side surface of the antenna; the parasitic metal plate has a first portion and a second portion, the first portion is disposed on a second side surface of the antenna, the second portion is disposed on a third side surface of the antenna, in which the second side surface is adjacent to the first side surface, and the third side surface is opposite to the first side surface; the radiation metal plate has a first portion, a second portion and a third portion, the first portion is disposed on the second side surface, the second portion is disposed on the third side surface, the third portion is disposed on the second side surface;

wherein, the second portion of the parasitic metal plate is located at a corresponding position above a first end of the ground metal plate, and extends towards the radiation metal plate; the third portion of the radiation metal plate is located at a corresponding position above a second end of the ground metal plate, and extends towards the parasitic metal plate; the second end is opposite to the first end.

2. The antenna as claimed in claim 1, wherein the supporting element is a ceramic substrate having a first side surface, a second side surface, and a third side surface, in which the second side surface is adjacent to the first side surface and the third side surface is opposite to the first side surface; the ground metal plate is disposed on the first side surface of the ceramic substrate; the first portion of the parasitic metal plate extends along a side of the ground metal plate and is disposed on the second side surface of the ceramic substrate, and the second portion of the parasitic metal plate is disposed on the third side surface of the ceramic substrate; the first portion of the radiation metal plate is disposed on the second side surface of the ceramic substrate, the second portion is disposed on the third side surface of the ceramic substrate, and the third portion is disposed on the second side surface of the ceramic substrate.

3. The antenna as claimed in claim 1, wherein the supporting element is a non-conductive solid material having a first side surface, a second side surface, and a third side surface, in which the second side surface is adjacent to the first side surface and the third side surface is opposite to the first side surface; the ground metal plate is disposed on the first side surface of the non-conductive solid material; the first portion of the parasitic metal plate extends along a side of the ground metal plate and is disposed on the second side surface of the non-conductive solid material, and the second portion of the parasitic metal plate is disposed on the third side surface of the non-conductive solid material; the first portion of the radiation metal plate is disposed on the second side surface of the non-conductive solid material, the second portion is disposed on the third side surface of the non-conductive solid material, and the third portion is disposed on the second side surface of the non-conductive solid material.

4. The antenna as claimed in claim 1, wherein the supporting element is a flexible printed circuit board (PCB), the ground metal plate is disposed at a bottom edge of the flexible PCB; the first portion of the parasitic metal plate extends upward from a side of the ground metal plate close to the first end, and the second portion of the parasitic metal plate extends horizontally from the first portion towards the second end of the ground metal plate; the first portion of the radiation metal plate is spaced by a distance from the side of the ground metal plate close to the second end and extends upward, the top of the first portion of the radiation metal plate and the top of the first portion of the parasitic metal plate are spaced by the same distance from the ground metal plate, the second portion of the radiation metal plate is disposed at the same level as the second portion of the parasitic metal plate, the second portion of the radiation metal plate extends towards the first end of the ground metal plate, the third portion of the radiation metal plate extends from the bottom of the second portion towards the first end of the ground metal plate until between the ground metal plate and the second portion of the parasitic metal plate.

5. The antenna as claimed in claim 4, wherein the flexible PCB is folded into a cuboid having a first side surface, a second side surface, and a third side surface, in which the second side surface is adjacent to the first side surface and the third side surface is opposite to the first side surface; the ground metal plate is disposed on the first side surface of the cuboid; the first portion of the parasitic metal plate extends along a side of the ground metal plate and is disposed on the second side surface of the cuboid, and the second portion of the parasitic metal plate is disposed on the third side surface of the cuboid; the first portion of the radiation metal plate is disposed on the second side surface of the cuboid, the second portion is disposed on the third side surface of the cuboid, and the third portion is disposed on the second side surface of the cuboid.

6. The antenna as claimed in claim 1, wherein a frequency of the resonance mode is 1575 MHz.

7. The antenna as claimed in claim 1, wherein the supporting element is an insulating element.

8. An antenna for GPS, comprising:

a ground metal plate;

a parasitic metal plate, disposed above the ground metal plate and connecting to the ground metal plate;

a radiation metal plate, disposed above the ground metal plate, wherein the radiation metal plate is an independent metal plate, and cooperates with the parasitic metal plate to induce a resonance mode; and at least one supporting element, disposed above the ground metal plate, for supporting the radiation metal plate, wherein the ground metal plate is disposed on a first side surface of the antenna; the parasitic metal plate has a first portion and a second portion, the first portion is disposed on a second side surface of the antenna, the second portion is disposed on a third side surface of the antenna, in which the second side surface is adjacent to the first side surface and the third side surface is opposite to the first side surface; the radiation metal plate has a first portion and a second portion, the first portion is disposed on the second side surface, the second portion is disposed on the third side surface;

wherein, the second portion of the parasitic metal plate is located at a corresponding position above a first end of the ground metal plate, and extends towards the radiation metal plate; the second portion of the radiation metal plate is located at a corresponding position above a second end of the ground metal plate, and extends towards the parasitic metal plate; the second end is opposite to the first end.

9. The antenna as claimed in claim 8, wherein the supporting element is a ceramic substrate having a first side surface, a second side surface, and a third side surface, in which the second side surface is adjacent to the first side surface and the third side surface is opposite to the first side surface; the ground metal plate is disposed on the first side surface of the ceramic substrate; the parasitic metal plate has a first portion and a second portion, the first portion is disposed on the second side surface of the ceramic substrate, the second portion is disposed on the third side surface of the ceramic substrate; the radiation metal plate has a first portion and a second portion, the first portion is disposed on the second side surface of the ceramic substrate, the second portion is disposed on the third side surface of the ceramic substrate.

10. The antenna as claimed in claim 8, wherein the supporting element is a non-conductive solid material having a first side surface, a second side surface, and a third side surface, in which the second side surface is adjacent to the first side surface and the third side surface is opposite to the first side surface; the ground metal plate is disposed on the first side surface of the non-conductive solid material; the parasitic metal plate has a first portion and a second portion, the first portion is disposed on the second side surface of the non-conductive solid material, the second portion is disposed on the third side surface of the non-conductive solid material; the radiation metal plate has a first portion and a second portion, the first portion is disposed on the second side surface of the non-conductive solid material, the second portion is disposed on the third side surface of the non-conductive solid material.

11. The antenna as claimed in claim 8, wherein the supporting element is a flexible PCB, and is folded into a cuboid having a first side surface, a second side surface, and a third side surface, in which the second side surface is adjacent to the first side surface and the third side surface is opposite to the first side surface; the ground metal plate is disposed on the first side surface of the cuboid; the parasitic metal plate has a first portion and a second portion, the first portion is disposed on the second side surface of the cuboid, the second portion is disposed on the third side surface of the cuboid; the radiation metal plate has a first portion and a second portion, the first portion is disposed on the second side surface of the cuboid, the second portion is disposed on the third side surface of the cuboid.

12. An antenna for GPS, comprising;

a ground metal plate;

a parasitic metal plate, disposed above the ground metal plate and connecting to the ground metal plate;

a radiation metal plate, disposed above the ground metal plate, wherein the radiation metal plate is an independent metal plate, and cooperates with the parasitic metal plate to induce a resonance mode; and at least one supporting element, disposed above the ground metal plate, for supporting the radiation metal plate, wherein the ground metal plate is disposed on a first side surface of the antenna; the parasitic metal plate has a first portion and a second portion both disposed on a second side surface of the antenna, in which the second side surface adjacent to the first side surface; the radiation metal plate has a first portion and a second portion, the first portion is disposed on the second side surface, the second portion is disposed on a third side surface of the antenna, in which the third side surface is opposite to the first side surface;

wherein, the second portion of the parasitic metal plate is located at a corresponding position above a first end of the ground metal plate, and extends towards the radiation metal plate; the second portion of the radiation metal plate is located at a corresponding position above a second end of the ground metal plate, and extends towards the parasitic metal plate, in which the second end is opposite to the first end.

13. The antenna as claimed in claim 12, wherein the supporting element is a ceramic substrate having a first side surface, a second side surface, and a third side surface, in which the second side surface is adjacent to the first side surface and the third side surface is opposite to the first side surface; the ground metal plate is disposed on the first side surface of the ceramic substrate; the parasitic metal plate has a first portion and a second portion both disposed on the second side surface of the ceramic substrate; the radiation metal plate has a first portion and a second portion, the first portion is disposed on the second side surface of the ceramic substrate, the second portion is disposed on the third side surface of the ceramic substrate.

14. The antenna as claimed in claim 12, wherein the supporting element is a non-conductive solid material having a first side surface, a second side surface, and a third side surface, in which the second side surface is adjacent to the first side surface and the third side surface is opposite to the first side surface; the ground metal plate is disposed on the first side surface of the non-conductive solid material; the parasitic metal plate has a first portion and a second portion both disposed on the second side surface of the non-conductive solid material; the radiation metal plate has a first portion and a second portion, the first portion is disposed on the second side surface of the non-conductive solid material, the second portion is disposed on the third side surface of the non-conductive solid material.

15. The antenna as claimed in claim 12, wherein the supporting element is a flexible PCB, and is folded into a cuboid having a first side surface, a second side surface, and a third side surface, in which the second side surface is adjacent to the first side surface and the third side surface is opposite to the first side surface; the ground metal plate is disposed on the first side surface of the cuboid; the parasitic metal plate has a first portion and a second portion both disposed on the second side surface of the cuboid; the radiation metal plate has a first portion and a second portion, the first portion is disposed on the second side surface of the cuboid, and the second portion is disposed on the third side surface of the cuboid.

16. An antenna for GPS, comprising:

a ground metal plate;

a parasitic metal plate, disposed above the ground metal plate and connecting to the ground metal plate;

a radiation metal plate, disposed above the ground metal plate, wherein the radiation metal plate is an independent metal plate, and cooperates with the parasitic metal plate to induce a resonance mode; and at least one supporting element, disposed above the ground metal plate, for supporting the radiation metal plate, wherein the ground metal plate is disposed on a first side surface of the antenna; the parasitic metal plate has a first portion and a second portion both disposed on a second side surface of the antenna, in which the second side surface is adjacent to the first side surface; the radiation metal plate has a first portion and a second portion both disposed on the second side surface;

wherein, the second portion of the parasitic metal plate is located at a corresponding position above a first end of the ground metal plate, and extends towards the radiation metal plate; the second portion of the radiation metal plate is located at a corresponding position above a second end of the ground metal plate, and extends towards the parasitic metal plate, in which the second end is opposite to the first end.

17. The antenna as claimed in claim 16, wherein the supporting element is a ceramic substrate having a first side surface, a second side surface, and a third side surface, in which the second side surface is adjacent to the first side surface and the third side surface is opposite to the first side surface; the ground metal plate is disposed on the first side surface of the ceramic substrate; the parasitic metal plate has a first portion and a second portion both disposed on the second side surface of the ceramic substrate; the radiation metal plate has a first portion and a second portion both disposed on the second side surface of the ceramic substrate.

18. The antenna as claimed in claim 16, wherein the supporting element is a non-conductive solid material having a first side surface, a second side surface, and a third side surface, in which the second side surface is adjacent to the first side surface and the third side surface is opposite to the first side surface; the ground metal plate is disposed on the first side surface of the non-conductive solid material; the parasitic metal plate has a first portion and a second portion both disposed on the second side surface of the non-conductive solid material; the radiation metal plate has a first portion and second portion both disposed on the second side surface of the non-conductive solid material.

19. The antenna as claimed in claim 16, wherein the supporting element is a flexible PCB, and is folded into a cuboid having a first side surface, a second side surface, and a third side surface, in which the second side surface is adjacent to the first side surface and the third side surface is opposite to the first side surface; the ground metal plate is disposed on the first side surface of the cuboid; the parasitic metal plate has a first portion and a second portion both disposed on the second side surface of the cuboid; the radiation metal plate has a first portion and a second portion both disposed on the second side surface of the cuboid.

20. The antenna as claimed in claim 16, wherein relative to the ground metal plate, the second portion of the parasitic metal plate and the second portion of the radiation metal plate are disposed at the same level.

21. The antenna as claimed in claim 16, wherein relative to the ground metal plate, the second portion of the parasitic metal plate is disposed at a level higher than that of the second portion of the radiation metal plate.

22. The antenna as claimed in claim 16, wherein relative to the ground metal plate, the second portion of the parasitic metal plate is disposed at a level lower than that of the second portion of the radiation metal plate.

* * * * *